US005203118A

United States Patent [19]

Bocquet

[11] Patent Number: 5,203,118

[45] Date of Patent: Apr. 20, 1993

[54] SKI GRINDING MACHINE

[75] Inventor: Jean-Pierre Bocquet, La Motte Servolex, France

[73] Assignee: SKID, Société anonyme, La Motte Servolex, France

[21] Appl. No.: 843,625

[22] Filed: Feb. 28, 1992

[30] Foreign Application Priority Data

Mar. 8, 1991 [FR] France ..... 91 02993

[51] Int. Cl.[5] ..... B24B 21/12; B24B 21/20

[52] U.S. Cl. ..... 51/139; 51/135 R; 51/135 BT; 51/267

[58] Field of Search ..... 51/135 R, 137, 139, 51/135 BT, 267

[56] References Cited

U.S. PATENT DOCUMENTS

| | | | |
|---|---|---|---|
| 2,274,268 | 2/1942 | Hercik | 51/138 R |
| 2,477,602 | 8/1949 | Herchenrider | 51/135 R |
| 2,526,423 | 10/1950 | Rudorff | 51/135 R |
| 2,699,016 | 1/1955 | Sherrill | 51/139 |
| 2,723,505 | 11/1955 | Krafft | 51/137 |
| 2,827,935 | 3/1958 | Alexander . | |
| 2,934,279 | 4/1960 | Nestor | 51/135 |
| 3,415,017 | 12/1968 | Murray | 51/139 |
| 4,137,673 | 2/1979 | La Tour . | |
| 4,503,642 | 3/1985 | Wilms | 51/135 R |
| 4,546,572 | 11/1985 | Fischer | 51/137 |
| 4,569,552 | 2/1986 | Fischer | 51/139 |
| 5,085,010 | 2/1992 | Grau | 51/135 R |

FOREIGN PATENT DOCUMENTS

| | | | |
|---|---|---|---|
| 2502718 | 7/1976 | Fed. Rep. of Germany . | |
| 48904 | 4/1989 | Fed. Rep. of Germany | 51/135 R |
| 2614819 | 11/1988 | France . | |
| 48505 | 5/1985 | Japan | 51/135 R |

*Primary Examiner*—Bruce M. Kisliuk
*Assistant Examiner*—Bo Bounkong
*Attorney, Agent, or Firm*—Ratner & Prestia

[57] ABSTRACT

The machine according to the invention consists of an abrasive belt 6 stretched between a support drum 3 and a return drum 5, this assembly being rotated by a motor 7 accommodated between support drum 3 and return drum 5 between the two lengths 61, 62 of abrasive belt that link the drums. Support drum 3 consists of at least two sections with different hardnesses, namely a section with a rigid peripheral surface for dry grinding and a section with an elastic peripheral surface for initial machining or surface polishing. A driving drum may be placed above support drum 3 for the motorized feeding of the ski.

14 Claims, 3 Drawing Sheets

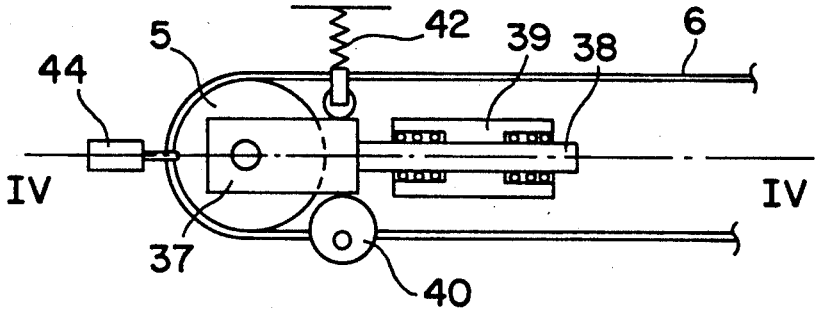
FIG. 3
FIG. 4
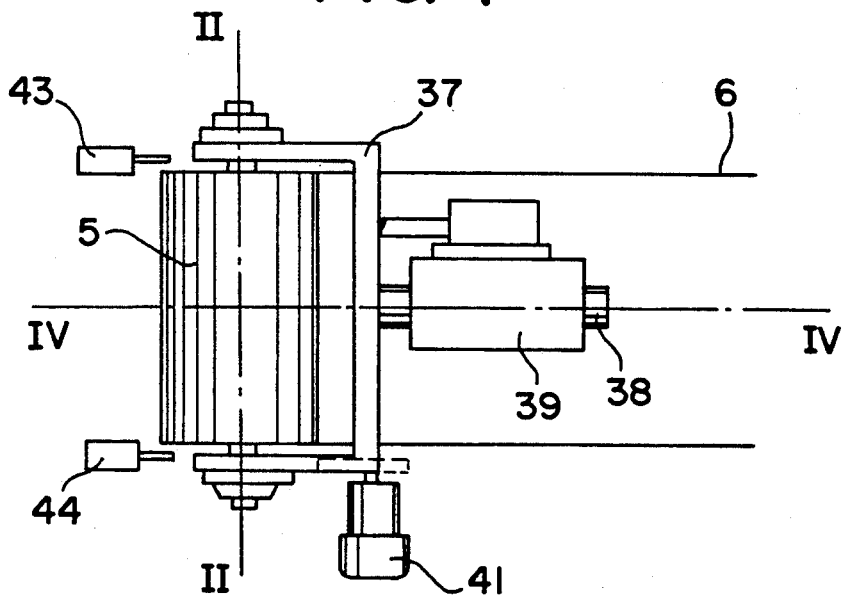
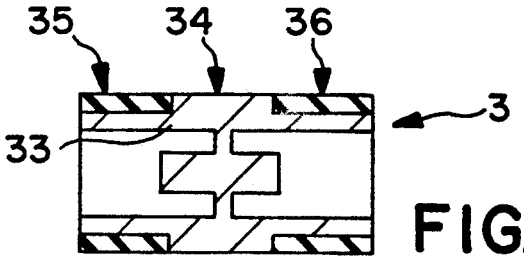
FIG. 5

SKI GRINDING MACHINE

BACKGROUND OF THE INVENTION

1. Field of the Invention

The present invention relates to machines used to grind skis, particularly their lower running surface.

2. Description of the Prior Art

Such machines are generally used to repair the bottoms of skis. The grinding operation may take place after resurfacing by overmoulding the running bottom.

Ski grinding machines in current use are generally machines having an abrasive belt consisting of a frame that stands on the floor and supports the functional units of the machine, a support drum mounted rotatably around a first horizontal axis, forming an accessible support area to accommodate the surface of the ski to be ground, a return drum mounted rotatably around a second horizontal axis offset with respect to the first axis and an abrasive belt stretched between the support drum and the return drum. Tensioning means pull at least one of the drums away from the other drum in order to tension the abrasive belt. Driving means are used to drive the support drum and abrasive belt. A system for circulating water sprays jets of water onto the area of the abrasive belt surrounding the support drum and collects the water that flows on the abrasive belt after it has passed through the machining area.

The abrasive belt is generally sufficiently wide to grind an alpine ski, i.e. its width is approximately 10 to 20 cm inclusive.

A similar technique is described in documents DE-A-2 502 718 and U.S. Pat. No. 2,827,935 for the machining of panels: the panels pass between an upper driving drum and a portion of an abrasive belt that surrounds a lower support drum.

In document U.S. Pat. No. 4,137,673, an abrasive belt is stretched between two rollers and forms a support sheet supported by a deformable mounting. The ski is machined by the support sheet and is driven by the driving rollers.

Machines that are usually used are, however, not wide enough to allow the entire width of a snow board to be ground in a single pass over the belt.

In addition, it seems that the grinding thus obtained does not always produce an adequate surface finish in terms of flatness and surface roughness. To achieve this, for example in document FR-A-2 614 819, special grinding machines having a grinding wheel or rigid drum have already been proposed. Such grinding by a grinding wheel is generally referred to as "dry grinding" and ensures flattening of the lower surface of the ski. It is then necessary to combine, in several passes on different machines, one or more grinding operations using an abrasive belt and at least one "dry grinding" operation. Each pass involves adjusting the belt speed, the feed speed of the ski in the machine and the pressure of the ski against the abrasive belt or grinding wheel. Results largely depend on the skill of the user and are inconsistent. This solution is therefore unsatisfactory in technical terms. In addition, the use of several machines significantly increases production costs, requires considerable space, complicates handling and experience shows that such complication is prohibitive for sports shops and persons who hire out ski equipment who often tend to make do with an abrasive-belt machine.

SUMMARY OF THE INVENTION

It is a particular object of the present invention to avoid the drawbacks of known machines by proposing a new structure for a ski grinding machine whereby a single machine can be used to successively perform initial grinding, "dry grinding" or polishing or flattening and final grinding operations. These various operations are made possible using a single machine thanks to facilities that make them compatible.

According to another aspect of the invention, the various operating capabilities of the machine according to the invention are obtained without any significant increase in the space or floor area taken up by the machine. On the contrary, the invention defines a new machine architecture that makes it possible to significantly reduce its overall dimensions and, in particular, its floor area.

Such an architecture also makes it possible to fit, in a single machine and without any significant increase in its cost or overall dimensions, means that perform grinding with chamfering of the edges: with such grinding, the edges of the ski undergo preferential removal of material so that their surface, after machining, is slightly recessed in relation to the polyethylene surface- that constitutes the central surface of the ski bottom.

According to another aspect of the invention, an attempt has been made to simplify the control of the functional units of the machine in order to avoid the user having to define and make time-consuming, tricky adjustments depending on the type of material that he wishes to machine and the machining process in progress. In particular, it is clear that provision must be made for various adjustments depending whether an alpine ski, mono-ski or snow board is involved and depending whether initial machining, polishing or flattening machining or final machining is involved. The user simply has to indicate the type of product and the type of process and the adjustments are then made automatically.

In order to achieve these objects as well as others, the ski grinding machine according to the invention comprises the following known traditional

- a frame standing on the floor that supports the functional units,
- a support drum mounted rotatably around a first horizontal axis, forming an accessible support area to accommodate the surface of the ski to be ground,
- a return drum mounted rotatably around a second horizontal axis offset with respect to the first axis,
- an abrasive belt stretched between the support drum and the return drum,
- tensioning means to pull at least one of the drums away from the other drum and to tension the abrasive belt,
- driving means to rotate the support drum and abrasive belt,
- water circulation means to spray water onto the area of the abrasive belt around the support drum and to collect water that flows on the abrasive belt;

According to the invention, the layout is as follows:

- the support drum consists of at least one first and one second successive longitudinal section each longer than the width of an alpine ski and having different surface hardnesses, namely a first section with an elastic surface having a peripheral area consisting of an elastic material such as rubber or flexible polyurethane and a second section with a rigid surface having a peripheral area consisting of a rigid material such as aluminium, The abrasive belt simultaneously covers all the successive sections of the support drum, The driving means are positioned in order to rotate the support drum at at least two different appropriate speeds equivalent, respectively, to a first initial machining or flattening process where the surface of the ski is ground at a high belt speed and a second finishing process where the surface of the ski is ground at a low belt speed, The return drum has means of centring the abrasive belt to guide said abrasive belt and to hold it close to a position that is essentially centrally aligned with the return and support drums.

Preferably, in order to obtain consistent results, the machine also has a driving drum mounted rotatably around a third horizontal axis that can be moved from a retracted position in which it is away from the support drum so as to allow insertion of the end of a ski and moved into a drive position in which it is close to the support drum and directed by pressing means to press a ski and hold it against the abrasive belt; the driving drum being rotated by a drive motor.

In a preferred embodiment, the support drum consists of three successive sections, namely a first outer section with an elastic surface, a second central section with a rigid surface and a third outer section with an elastic surface. The total length of the support drum and the equivalent useful length of the abrasive belt exceed the width of a snow board. With such a structure, the user can use the same abrasive belt to grind an alpine ski, a mono-ski or a snow board without distinction. "Dry grinding" or finishing operations are performed using the second central section with a rigid surface. Initial machining and surface flattening operations are performed on the first outer section or the third outer section with an elastic surface.

In order to achieve a significant reduction in overall dimensions, the machine according to the invention:

Consists of a support drum and a return drum arranged along two axes essentially located in the same vertical plane, Any driving drum provided is also arranged along an axis located in the same vertical plane, The drive motor of the support drum is accommodated between the support drum and return drum and between the two lengths of abrasive belt that link said drums.

In one advantageous embodiment, the support drum has an additional section with a very elastic surface surrounded by a circular abrasive belt kept flat around its entire periphery which is at least as wide as a ski, the circular abrasive belt being of a type that has an aggressive action on the steel that forms the edges of the ski and a less aggressive action on the polyethylene running bottom so that the machine has a support drum area that can be used to chamfer the edges.

The machine is controlled by a control device consisting of an operator's console mounted on the frame with the operator's console ideally being equipped with a set of pedals linked to the chassis that actuate a set of switches corresponding to several basic cycles such as:

an initial machining cycle for the bottom of an alpine ski with a high belt speed, a low ski feed speed and a medium or low pressure force, a finishing cycle for an alpine ski with a low belt speed, a high ski feed speed and a low pressure force, a flattening cycle for the bottom of an alpine ski with a high belt speed, a low ski feed speed and a high or medium pressure force, a finishing cycle for a snow board with a low belt speed, a low ski feed speed and a high pressure force, an edge chamfer cycle with a high belt speed, a low ski feed speed and a low or medium pressure force.

BRIEF DESCRIPTION OF THE DRAWINGS

Further objects, characteristics and advantages of the present invention will be apparent from the following description of particular embodiments, reference being made to the accompanying drawings in which:

FIG. 3 shows a side view of the general structure of a device for centring the abrasive belt according to one possible embodiment;

FIG. 4 is a front view of the device for centring the abrasive belt as shown in FIG. 3;

FIG. 5 is a longitudinal section of a support drum according to one embodiment of the invention;

DESCRIPTION OF THE PREFERRED EMBODIMENTS

Figure 1:
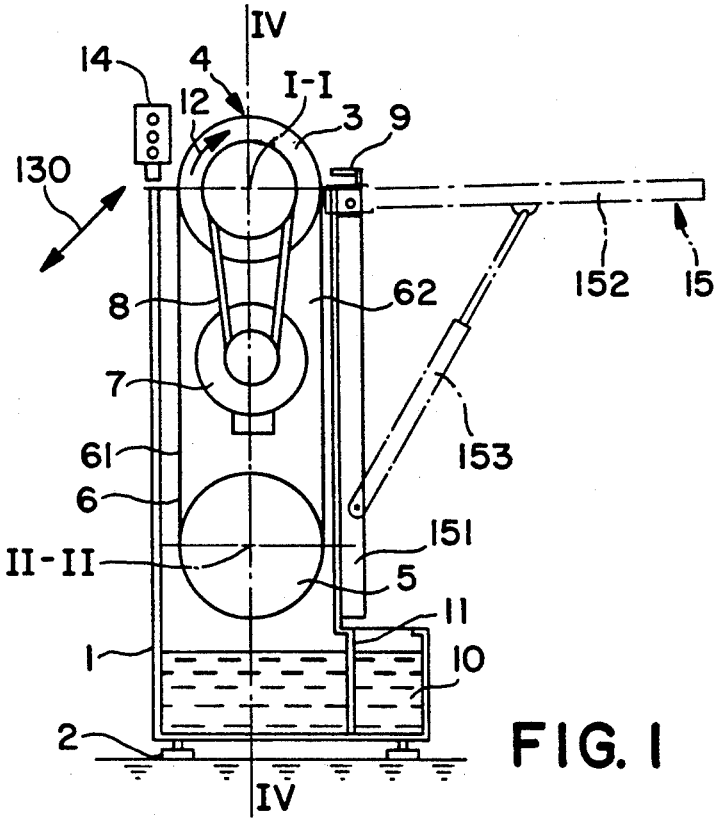
FIG. 1 is a general side section of a machine according to a first embodiment of the present invention.

FIG. 1 shows a machine according to the present invention in a simplified embodiment that does not have a driving drum. In this embodiment as well as in those described below, the machine consists of a frame 1 that stands on the floor with feet 2 and supports all the functional units of the machine.

The functional units consist of a support drum 3 mounted rotatably around a first horizontal axis I—I whose upper peripheral area forms a support area outside of frame 1.

The functional units also comprise a return drum 5 mounted rotatably around a second horizontal axis II—II that is offset with respect to the first axis I—I.

An abrasive belt 6 is threaded round support drum 3 and return drum 5. Tensioning means (not shown in FIG. 1) pull return drum 5 away from support drum 3 in order to tension abrasive belt 6. The upper part 4 of abrasive belt 6 that covers the support area outside of support drum 3 can be accessed by the user and is intended to accommodate the ski surface to be ground. In order to allow the grinding of snow boards, it is useful to ensure that the total length of support drum 3 and the width of abrasive belt 6 exceed the width of a snow board.

A motor 7 is coupled to support drum 3 via transmission belt 8 and rotates support drum 3 and abrasive belt 6 in the preferred direction of rotation shown by arrow 12.

Means of spraying water are used to sprinkle water on the upper part 4 of the abrasive belt around support drum 3 and to collect water that runs on abrasive belt 6. For example, spray nozzles 9 are designed to apply jets of water to upper part 4 on which machining takes place and tray 10 is provided in the lower part of the machine in order to collect water that flows on abrasive belt 6 with filter 11 being fitted in tray 10 in order to filter the collected water; means of pumping and piping are used to draw water from the filtered part of tray 10 and deliver it to spray nozzles 9.

In this embodiment, the user must hold a ski in a slanting position and apply its running surface to upper part 4 of abrasive belt 6 around support drum 3. The user moves the ski alternately in both directions at a slanting angle as shown by double arrow 130 so that all parts of the running surface of the ski are successively applied to the abrasive belt. The quality of the surface finish obtained on the running surface of the ski depends on several factors, particularly the speed of rotation of abrasive belt 6. For this purpose, the user has an operator's console 14 equipped with several push-buttons that allow him to select various speeds of motor 7.

In order to collect sprayed water and support the ski before it passes over support drum 3, it is useful to provide a feed table 15 joined to frame 1 by a hinge so as to provide a folded down position 151 shown in a solid line in FIG. 1 and a horizontal unfolded position 152 shown in a dot-and-dash line in the same figure. In the unfolded position, feed table 15 provides a horizontal support that is slightly lower than the level of the upper generating line of support drum 3 and extends into the ski feed area perpendicular to axis I—I of support drum 3. Cylinders 153 are used to secure feed table 15 in its unfolded position.

The relative layout of the various functional units as shown in FIG. 1 results in a particularly compact machine requiring little space and a small floor area. With this architecture, support drum 3 is arranged along axis I—I located essentially in the same vertical plane IV—IV as axis II—II of return drum 5 with support drum 3 being above return drum 5. Motor 7 is accommodated between support drum 3 and return drum 5 between the two lengths 61 and 62 of abrasive belt that link said drums 3 and 5. Motor 7 is naturally protected against sprayed water by abrasive belt 6 itself without the need for any additional protective measures.

Figure 2:
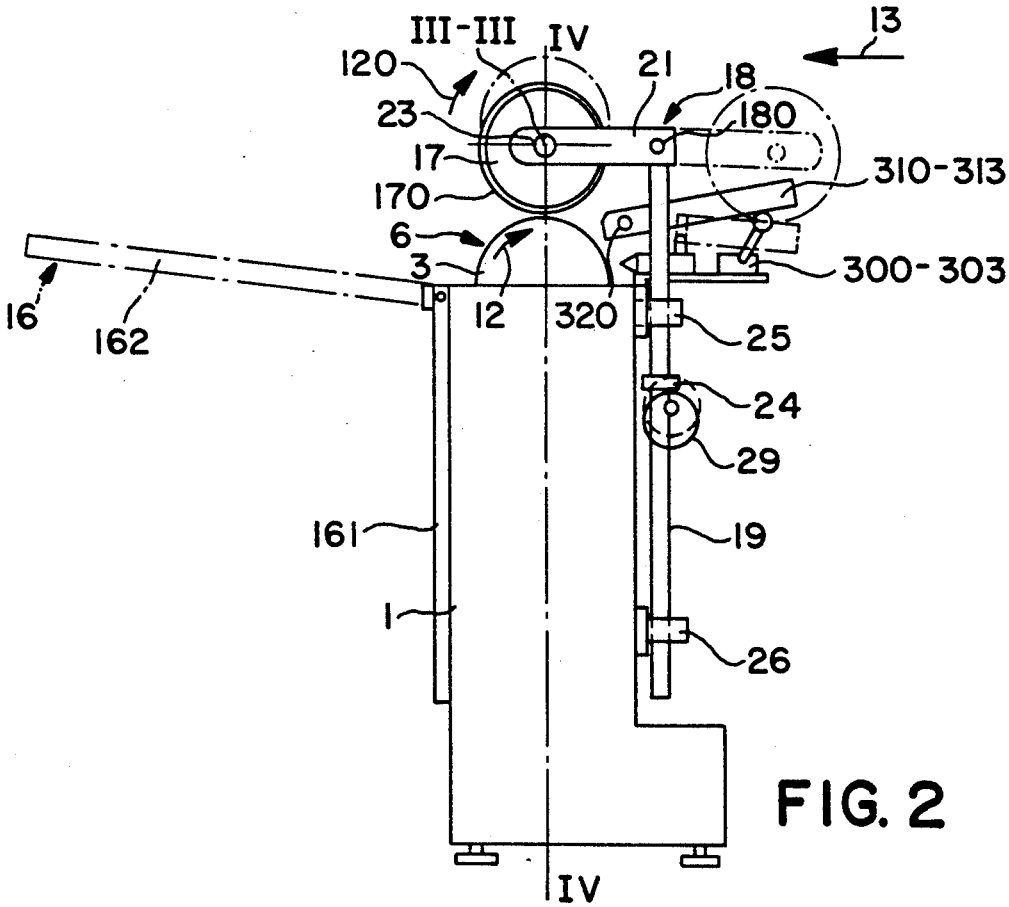
FIG. 2 is a side view of a machine according to a second embodiment of the invention that has a driving drum.

In the more comprehensive embodiment shown diagrammatically in FIG. 2, frame 1 supports the same functional units laid out in the same manner as in the embodiment in FIG. 1. For the sake of clarity, some functional units are not explicitly shown in FIG. 2. The only items shown are the additional facilities consisting of driving drum 17 and its means of actuation as well as delivery table 16 that can be added and joined to frame 1 by a hinge and which has a folded up position 161 and an unfolded position 162 in the ski delivery area.

Thus, in the embodiment in FIG. 2, the machine also consists of driving drum 17 mounted rotatably around a third horizontal axis III—III. Driving drum 17 is placed above support drum 3 with its axis III—III being essentially located in the same vertical plane IV—IV as the axes of support drum 3 and return drum. Driving drum 17 can be moved to a raised position shown in a dot-and-dash line in FIG. 2 in which it is away from support drum 3 in order to allow insertion of the end of a ski between the two drums at right angles to their axes and moved to a drive position shown in a solid line in which it is close to the support drum and driven by pressing means to press a ski and hold it against abrasive belt 6.

Driving drum 17 is covered with coaxial elastic rings 170 distributed over its length and designed to encourage adhesion of the ski while it is being fed in. These elastic rings will ideally have a Shore hardness of 40 to 60 A inclusive.

Driving drum 17 is rotated around its axis III—III in the direction of arrow 120 by a drive motor that is not shown in the figure. In this way, driving drum 17 feeds the ski horizontally in the direction shown by arrow 13 which is opposite the direction of rotation 12 of abrasive belt 6. Ideally, the drive motor is accommodated inside driving drum 17 itself and rotates the outer covering of driving drum 17 relative to central shaft 23. The drive motor is designed to produce at least two different drive speeds, namely a low speed and a high speed.

Driving drum 17 can also be retracted by swivelling around transverse axis 180 of carriage 18 in order to completely release the upper working part 4 of abrasive belt 6 in order to carry out grinding work using manual feed. The retracted position is shown in dot-and-dash lines in FIG. 2.

Figure 6:
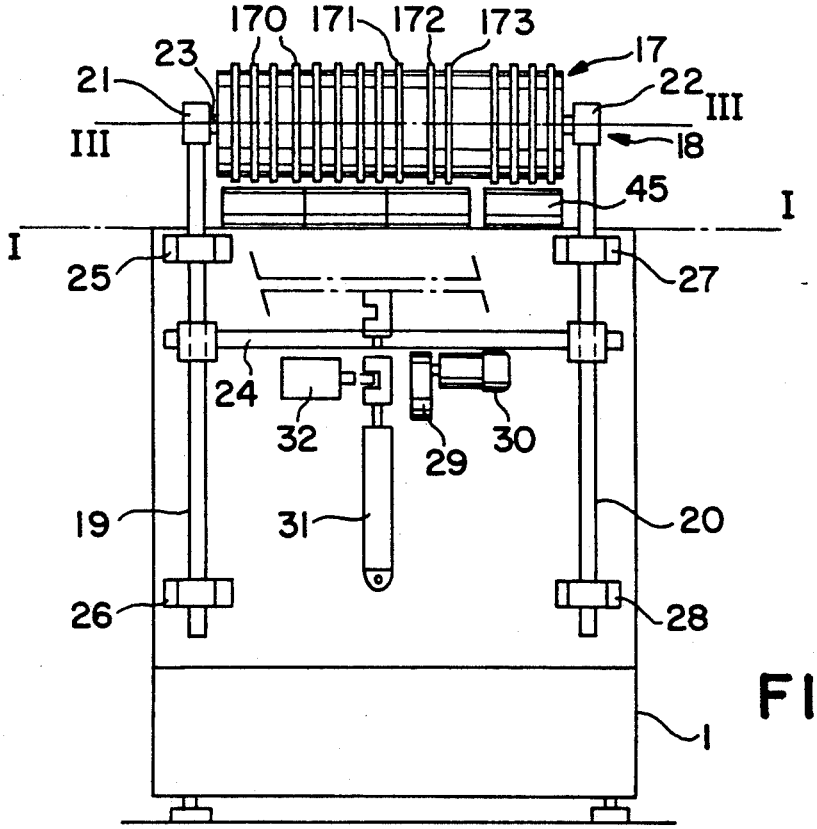
FIG. 6 is a front view of a machine according to the invention in the embodiment shown in FIG. 2.

Central shaft 23 is mounted so that it is fixed on carriage 18 that slides on the lateral vertical guides of frame 1. As shown in FIGS. 2 and 6, carriage 18 has two vertical uprights 19 and 20 whose upper ends are joined to two anterior-posterior beams 21 and 22 connected to each other by fixed shaft 23. Uprights 19 and 20 are also connected to each other by intermediate crosspiece 24 and they slide vertically in the respective lateral guides 25, 26, 27 and 28 of frame 1. Under its own weight, carriage 18 rests freely via its crosspiece 24 on cam 29 rotating around a horizontal axis and driven by carriage motor 30. When the carriage motor 30 rotates, cam 29 executes a cycle during which it extends and gradually pushes carriage 18 upwards in order to move driving drum 17 away from support drum 3 and then retracts, thus allowing driving drum 17 to drop down towards support drum 3. When cam 29 is in its retracted position, driving drum 17 is therefore driven by the weight of carriage 18 and driving drum 17 towards support drum 3. Ideally, the weight of the assembly consisting of driving drum 17 and carriage 18 is equivalent to the maximum force that must be exerted in order to hold the ski against support drum 3 during the various grinding processes.

In a useful embodiment shown in FIG. 2, carriage motor 30 is controlled by at least one switch 300 that can be actuated by a push-button or, more advantageously, by a pedal 310 that is joined to frame 1 by a hinge along transverse shaft 320 and can be accessed by the user. Pedal 310 can be located on the upper side of frame 1 so that it can easily be actuated by pressing the ski to be ground against it. Pedal 310 is preferably arranged so that it acts as a ski feed support that holds the ski in a position that is essentially horizontal as it passes between drums 3 and 17. Ideally, one press of the switch triggers the execution of a complete cycle of cam 29 with raising and lowering of driving drum 17 as well as operation of the other units of the device.

In one embodiment, it is useful to provide an auxiliary means of adjusting the pressure force of driving drum 17. For instance, a particularly simple embodiment involves making provision for two different pressure forces that can be selected depending on the desired machining process. The first pressure force is the highest and is obtained by allowing carriage 18 to move vertically so that all the weight of driving drum 17 and carriage 18 is applied. A second lower pressure force is obtained by actuating a gas cylinder 31 pressing against crosspiece 24 of carriage 18 in order to push crosspiece 24 and carriage 18 that supports driving drum 17 upwards. The thrust of gas cylinder 31 can be eliminated by ensuring that the rod of gas cylinder 31 simply hits the lower face of crosspiece 24 in order to push it upwards and that a moveable limit stop 32 makes it possible to retain cylinder rod 31 in a lower position or enable its movement to push the carriage. Moveable limit stop 32 is actuated by an electromagnet or electric trigger or cylinder or any other means controlled by the user or by switch 300. In this way, carriage 18, cam 29 and cylinder 31 provide an appropriate pressing means in order to produce at least two different pressure forces, a low pressure force when gas cylinder 31 is active and a high pressure force when cylinder 31 is disabled.

An intermediate pressure force can easily be obtained by adding an additional gas cylinder and electromagnet that are used to obtain a "medium" pressure force. In fact, it may be useful to provide an additional adjustment of the pressure force giving a "medium force" either to reduce the aggressive action of a new abrasive belt by changing from a high force to a medium force or, conversely, to increase the effectiveness of a worn abrasive belt by changing from a low force to a medium force. This additional adjustment can be obtained by at least one additional adjustment switch that actuates the additional gas cylinder.

According to the invention, support drum 3 consists of at least a first longitudinal and a second section successive longitudinal section each longer than the width of an alpine ski and having different surface hardnesses, namely a first section with an elastic surface having a peripheral area consisting of elastic material and a second section with a rigid surface having a peripheral area consisting of a rigid material.

For example, in the embodiment shown in the longitudinal cross section in FIG. 5, support drum 3 consists of a core 33 made of a rigid material such as aluminium. Core 33 actually constitutes the periphery of central section 34 of support drum 3. The peripheries of the two outer sections 35 and 36 consist of a binding made of an elastic material such as an elastomer. All the peripheries of central section 34 and peripheral sections 35 and 36 constitute the revolving, generally cylindrical, external surface of support drum 3. In this embodiment, support drum 3 comprises three successive sections, namely a first outer section 35 with an elastic peripheral surface, a second central section 34 with a rigid peripheral surface and a third outer section 36 with an elastic peripheral surface.

A simplified embodiment is to provide a support drum 3 that only has two successive sections, for example section 35 with an elastic peripheral surface, and section 34 with a rigid peripheral surface.

In all the embodiments, abrasive belt 6 simultaneously covers all the successive sections of support drum 3.

Providing successive sections of different hardness makes it possible, using the same abrasive belt, to machine the running surface of a ski under different conditions in order to obtain appropriate surface finishes and enhanced machining efficiency. Since each section of support drum 3 is at least as long as the width of an alpine ski, i.e. is longer than approximately 10 cm, it is possible to provide several machining processes with each process using one of the sections of the same support drum 3. The problem is that when the ski is pressed against that part of the abrasive belt located opposite a section of support drum 3 with an elastic surface, e.g. section 35, this pressing of the ski slightly deforms the peripheral surface of support drum 3 and tends to unbalance abrasive belt 6. As a result, the abrasive belt has a tendency to move axially on support drum 3 and, possibly, on return drum 5. To avoid this, the present invention makes provision for means of centring the abrasive belt in order to guide said belt and ensure that it is held close to a position that is essentially centrally aligned with return drum 5 and support drum 3.

Various means of centring may be used. For instance, FIGS. 3 and 4 show one possible embodiment of the means of centring fitted on return drum 5. In this embodiment, return drum 5 rotates freely around its axis II—II and is mounted in a stirrup piece 37 with stirrup piece 37 being joined to central slide rod 38 fitted so that it slides in guide 39 of frame 1. Rod 38 may also swivel freely in guide 39 around its longitudinal axis that is located in the vertical plane IV—IV of the machine and perpendicular to axis II—II. A centring cam 40 actuated by centring motor 41 that is associated with opposite spring 42 controls swivelling of stirrup piece 37 around its axis determined by rod 38 in guide 39 with the possibility of deflection several degrees either side of an average position in which axis II—II is parallel to axis I—I of support drum 3. Motor 41 is controlled by a control device as a function of signals generated by two sensors 43 and 44 that detect the position of opposite edges of abrasive belt 6. The device is designed so that if one of the sensors, e.g. sensor 43, detects displacement of abrasive belt 6 towards the corresponding edge of return drum 5, motor 41 is actuated to produce swivelling of stirrup piece 37 and return drum 5 in a direction that causes abrasive belt 6 to return towards the centre of return drum 5.

The sections with an elastic surface, e.g. sections 35 and 36, consist of a portion of metal drum, namely core 33, covered with a grooved surface layer of elastic material having a Shore hardness of 35 to 90 A inclusive.

In the embodiments that include a driving drum 17, because the driving drum is covered with coaxial elastic rings such as rings 170–173 distributed over its length, it is useful to ensure a special distribution of the rings that makes it possible to increase still further the facilities to flatten a ski with a convex or concave transverse profile.

Figure 7:
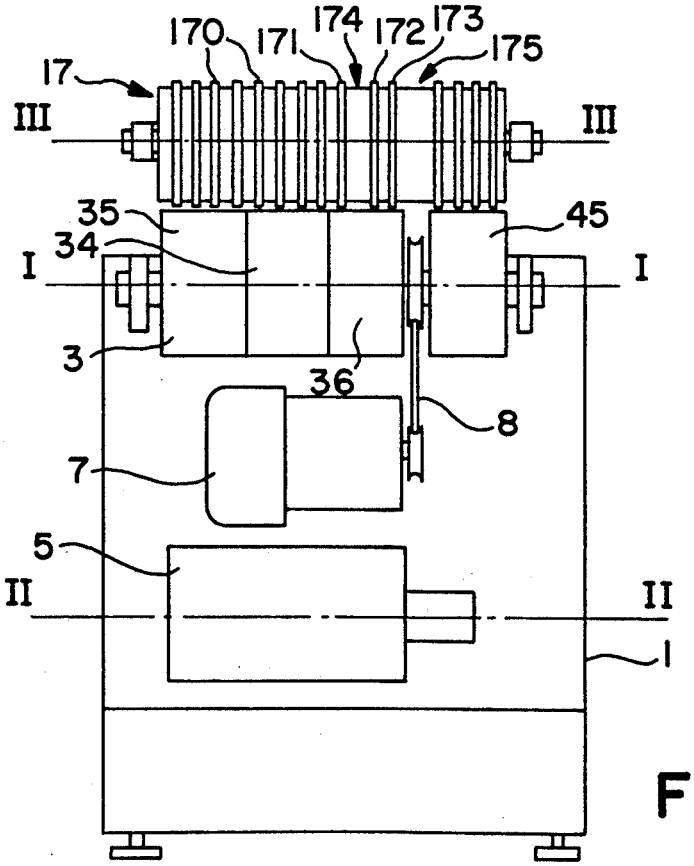
FIG. 7 is a front view of a cross section through the centre line of the machine according to FIG. 6.

To achieve this, as shown in FIGS. 6 and 7, opposite one of the elastic sections 35 or 36, e.g. opposite elastic section 36 of support drum 3, driving drum 17 has two consecutive elastic rings 171 and 172 separated from each other by space 174. Space 174 ideally equals roughly half the distance that separates the two lateral edge lines of an alpine ski. Since the lateral edge lines of an alpine ski are spaced 65 to 95 mm apart, a space 174 equal to approximately 30 to 40 mm may be suitable. The two elastic rings 171 and 172 then constitute two lateral support areas that improve the flateening of a ski having a concave transverse profile.

Similarly, opposite one of the elastic sections, e.g. elastic section 36 of support drum 3, driving drum 17 has two spaces or lateral areas 174 and 175 without rings that are separated by a central area fitted with two rings 172 and 173. The width of the central area fitted with two rings 172 and 173 is roughly half the distance that separates the two lateral edge lines of an alpine ski, i.e. approximately 30 to 40 mm. This produces a central support area, thus improving the flattening of a ski having a convex transverse profile.

The architecture of the machine according to the present invention also makes it possible, without significantly increasing the total space taken up by the machine, to adapt an additional section of the support drum, thus making it possible to perform special machining in order to chamfer the edges. FIGS. 6 and 7 illustrate such an embodiment where, on a single axis I—I as an extension of support drum 3 an additional section 45 with an elastic surface has been provided. Additional section 45 is not intended to be surrounded by the same abrasive belt 6; it is surrounded by a special circular abrasive belt that, over its entire circumference is held against section 45 and is at least as wide as the width of an alpine ski. The circular abrasive belt is of a type that has an aggressive action on the steel that forms the edges of the ski but has a less aggressive effect on the polyethylene running bottom. Additional section 45 is joined to support drum 3 and rotates with it and has essentially the same outside diameter as support drum 3. The length of driving drum 17 is sufficiently long to be essentially equal to the total length of the assembly formed by support drum 3 and additional section 45.

In the embodiments that include a driving drum 17, the pressing means that drive driving drum 17 towards support drum 3 allow a fairly wide clearance between driving drum 17 so that the machine can be used to machine the lower running surface of a ski without removing the bindings that are screwed to the upper surface of the ski. To achieve this, a straddle is fitted on the upper surface of the ski and the assembly consisting of the ski and the straddle is passed between driving drum 17 and support drum 3.

The same technique is used to machine a snow board: the straddle can be positioned along the longitudinal central axis of the snow board or it can be laterally offset, thus making it possible to grind the lower surface of the snow board in several passes even if the board has an unadjusted lower surface.

Grinding a lower running surface of a ski generally involves several processes during which the means of grinding has to operate on the basis of different parameters.

In particular, the speed of abrasive belt 6 is ideally between 5 and 15 meters per second inclusive for surface finishing processes and between 15 and 30 meters per second for initial machining or flattening processes.

The feed speed of the ski obtained by driving drum 17 is ideally between 4 and 6 meters per minute during an initial surface finish machining process and between 8 and 12 meters per minute for a finishing process.

The pressure force of driving drum 17 in the direction of support drum 3 for an alpine ski can be of the order of 200N for initial machining processes and of the order of 100N for surface finishing processes. When machining a snow board, the pressure force can be kept equal to roughly 300N even during surface finishing processes.

For a flattening process performed using additional section 45, one should preferably use the high speed of support drum 3, i.e. a tangential speed from 15 to 30 meters per second, a pressure force of roughly 150 to 200N and a ski feed speed from 4 to 6 meters per minute inclusive.

It is apparent that a fairly large number of adjustments has to be made on the functional components of the machine depending on the type of product to be ground and the machining process that is being executed. Default adjustments may cause inappropriate surface finishes and may even involve the risk of accidents with the ski being suddenly ejected by the machine instead of being fed in the normal direction.

In order to solve these difficulties, the present invention makes provision for automatic controls that ensure complete adjustment of the functional components of the machine depending on the operations to be performed on the ski. In one useful embodiment, the machine according to the invention has means of detecting the presence of a ski, the type of ski to be ground depending on its width and the type of operation that the user wishes to perform on the ski. The type of ski is detected depending on its width by sensors. Detection of the presence of the ski and the type of operation are obtained by sensing the position that the ski occupies along the axis of the drums. To achieve this, in the embodiment shown in FIG. 2, 4 pedals 310 to 313 that are similar to pedal 310 shown in the figure are articulated around the same transverse shaft 320 of frame 1. The pedals are pushed upwards by elastic devices that are not shown and each pedal rests against a lever that actuates one of the four switches 300 to 303 that are similar to switch 300 that is shown. If the reader refers to FIGS. 6 and 7, pedals 310 to 313 that are not shown are positioned at the entrance to the machine opposite the areas defined by sections 35, 34, 36 and 45 of support drum 3 respectively and are each narrower than the respective sections of support drum 3. When an alpine ski is placed in the machine in area 35 of support drum 3, the ski rests against pedal 310 which actuates switch 300. If the same alpine ski is placed in area 34, switch 301 is actuated. The same applies if the ski is placed in areas 36 or 45 respectively that actuates switches 302 or 303. A mono-ski or a snow board that is wider than an alpine ski automatically causes actuation of two successive pedals. One or more of the four pedals 310 to 313 operated by the ski to be machined actuates switches 300 to 303 respectively that send signals to a control circuit accommodated in frame 1 that is not shown in the figures. The control circuit can be based on relays, electronic circuits or any other technology known by professionals suitable to fulfil the desired functions of controlling functional units such as motor 7, centring motor 41, carriage motor 30, moveable limit stop 32 and the water sprinkler 9.

Water sprinkler 9 can ideally be arranged so that it only sprays water on those areas of the belt opposite the pedal(s) that was/were actuated. This confines the spraying of water to those areas where it is needed and concentrates the belt cooling effect produced by the water in these areas.

For instance, pedals 310 to 313 respectively actuate four switches 300 to 303 that select appropriate adjustments for the four areas defined respectively by sections 34, 35, 36 and 45 on support drum 3 so that:

When the control circuit receives a signal from switch 300 for an alpine ski initial machining cycle, it causes fast running of motor 7 and abrasive belt 6, slow running of the drive motor for driving drum 17 and enables cylinder 31 by means of limit stop 32 in order to produce a low or medium pressure force exerted on the ski by driving drum 17;

If the control circuit receives a signal from switch 301 for an alpine ski finishing process, it causes slow running of motor 7 and abrasive belt 6, fast running of drive motor for driving drum 17 and enabling of gas cylinder 31 by means of moveable limit stop 32 in order to reduce the pressure force exerted on the ski by driving drum 17;

If the control circuit receives a signal from switch 302 for a ski flattening cycle, it orders fast running of motor 7 and abrasive belt 6, slow running of the drive motor for driving drum 17 and disabling of cylinder 31 by moveable limit stop 32 in order to ensure a high or medium pressure force is exerted on the ski by driving drum 17;

If the control circuit receives a signal from at least two of switches 300 to 302 for a snow board initial machining cycle, it produces fast running of motor 7 and abrasive belt 6, slow running of the drive motor for driving drum 17 and disabling of cylinder 31 by moveable limit stop 32 in order to ensure a high pressure force is exerted on the ski by driving drum 17;

If the control circuit simultaneously receives a signal from at least two of switches 300 to 302 and a signal from a finishing switch actuated by the operator (not shown) for a snow board finishing cycle, it initiates slow running of motor 7 and abrasive belt 6, slow running of the drive motor for driving drum 17 and disabling of cylinder 31 by moveable limit stop 32 in order to retain a high pressure force exerted on the ski by driving drum 17;

If the circuit receives a signal from switch 303 for an alpine ski edge chamfering process, it initiates fast running of motor 7 and support drum 3 that supports the circular belt on additional section 45, slow running of the drive motor for driving drum 17 and enabling of gas cylinder 31 by moveable limit stop 32 in order to ensure a low or medium pressure force is exerted on the ski by driving drum 17.

During an initial machining process for surface finishing an alpine ski, the user passes the ski between driving drum 17 and support drum 3 in an abrasive belt area that corresponds to longitudinal section 35 that has an elastic peripheral surface. For a "dry grinding" or finishing process, the user runs the ski opposite that part of the belt that corresponds to a section with a rigid peripheral surface such as section 34. For a finishing or initial machining process on a snow board, the user runs the snow board simultaneously over the entire width of the abrasive belt equivalent to the three sections 34, 35 and 36 of support drum 3. For an edge chamfering process, the user runs the ski between driving drum 17 and additional section 45.

For an alpine ski flattening process, the user runs the ski opposite that part of the belt corresponding to a section with an elastic peripheral surface such as section 36. If the bottom of the ski has a concave or dished transverse profile, the user centres the ski opposite space 174 that separates rings 171 and 172. The lateral areas of the ski then rest against the two rings 171 and 172. The absence of support between the two rings 171 and 172 in space 174 concentrates the grinding pressure force on the left and right-hand lateral areas of the bottom of the ski and encourages flattening of the ski.

Conversely, if the bottom of the ski has a convex or domed transverse profile, the user centres the ski opposite rings 172 and 173 next to spaces 174 and 175 that have no rings. The grinding pressure force is then concentrated on the central area of the ski and encourages flattening of the ski.

The layout of the means of detecting the presence and the type of ski and the type of operation to be performed was described in connection with a special structure of the multifunction abrasive-belt grinding machine according to the invention. Nevertheless, it is possible to provide such facilities on various multifunction tools, e.g. those that have no abrasive belt.

The present invention is not limited to the embodiments that are explicitly described and includes the various variations and generalisations contained in the scope of the invention as defined in the appended claims.

I claim:

1. Ski grinding machine for grinding a surface of a ski having a width comprising:

a frame standing on a floor, a support drum mounted rotatably around a first horizontal axis, forming an accessible support area to accommodate the surface of the ski to be ground, a return drum mounted rotatably around a second horizontal axis, an abrasive belt stretched between the support drum and the return drum, tensioning means to pull at least one of the drums away from the other drum and to tension the abrasive belt, driving means to rotate the support drum and the abrasive belt, water circulation means to spray water onto the area of the abrasive belt around the support drum and to collect water that flows on the abrasive belt, the support drum comprises at least one first longitudinal section, which includes a circumferential surface of the drum, and one second longitudinal section, which includes a circumferential surface of the drum, side-by-side with and extending longitudinally away from the first section, the first and second sections each longer than the width of an said alpine ski and having different surface hardnesses, the first section with an elastic surface having a peripheral area comprising an elastic material for performing a first grinding operation on the surface of the ski and the second section with a rigid surface having a peripheral area comprising a rigid material aluminum for performing a second grinding operation on the surface of the ski, the abrasive belt simultaneously covers all sections of the support drum, driving means positioned in order to rotate the support drum at least two different appropriate speeds corresponding, respectively, to a first initial machining or flattening process where the surface of the ski is ground at a high belt speed and a second finishing process where the surface of the ski is ground at a low belt speed, and the return drum having means of centering the abrasive belt to guide said abrasive belt and hold it close to a position that is essentially centrally aligned with the return drum and the support drum.

2. A machine according to claim 1, wherein the section with an elastic surface consists of a portion of metal drum covered with a grooved surface layer of elastic material having a Shore hardness of 35 to 90 A inclusive.

3. A machine according to claim 1, wherein:

the support drum consists of three successive sections, namely a first outer section with an elastic surface, a second central section with a rigid surface and a third outer section with an elastic surface, and the support drum and the abrasive belt, each have lengths which exceed the width of a snow board.

4. A machine according to claim 1 further comprising a driving drum mounted rotatably around a third horizontal axis that can be moved from a raised position in which the driving drum is away from the support drum so as to allow insertion of the end of a ski and moved to a drive position in which the driving drum is close to the support drum and driven toward the support drum by pressing means to press the ski and hold the driving drum against the abrasive belt, the driving drum being rotated by a drive motor.

5. A machine according to claim 4, wherein:

pressing means are designed to produce at least two different pressure forces, a low force and a high force, the drive motor is designed to produce at least two different drive speeds, namely a low speed and a high speed.

6. A machine according to claim 4, wherein the driving drum is mounted on a carriage that slides on lateral vertical guides.

7. A machine according to claim 6, wherein the sliding carriage rests freely on the cam which actuates the sliding carriage vertically, the cam being driven by an electric carriage motor controlled by at least one switch, with a press of a switch triggering the execution of a complete cam cycle with raising and lowering of the driving drum.

8. A machine according to claim 7, wherein:

a gas cylinder with a cylinder rod presses against the sliding carriage and pushes the sliding carriage upwards with a predetermined force, a moveable limit stop is used to retain the cylinder rod in its lower position or enable its movement to push the carriage.

9. A machine according to claim 4, wherein:

the driving drum is covered with coaxial elastic rings distributed over its length, opposite one of the sections of the support drum having an elastic surface, the driving drum has two consecutive elastic rings separated from each other by a space equal to roughly half the distance that separates the two lateral edge lines of an alpine ski, thus constituting two lateral support areas for flattening a ski having a concave transverse profile.

10. A machine according to claim 4, wherein:

the driving drum is covered with coaxial elastic rings distributed over its length, opposite one of the sections of the support drum having an elastic surface, the driving drum has two lateral areas without rings that are separated by a central area fitted with rings that is as wide as roughly half the distance that separates the two lateral edge lines of an alpine ski, thus constituting a central support area for flattening a ski having a convex transverse profile.

11. A machine according to claim 1, wherein:

the machine further comprises a support drum and a return drum arranged along two axes essentially located in the same vertical plane, if provided, the driving drum is also arranged along an axis located in the same vertical, plane, and a drive motor for driving the support drum is accommodated between the support drum and the return drum and between the two length of the abrasive belt that link said drums.

12. A machine according to claim 1 further comprising at least one folding feed table articulated on the frame that, in its horizontal unfolded position, supports the ski before the ski passes between the support drum and the driving drum, the table being foldable up vertically against the frame.

13. A machine according to claim 1 for grinding a ski having steel edges and a polyethylene running bottom, wherein the support drum has an additional section with an elastic surface surrounded by a circular abrasive belt kept flat around its entire periphery and at least as wide as a ski, the circular abrasive belt being of a type that has an aggressive action on the steel edges of the ski but a less aggressive action on the polyethylene running bottom, so that the machine has a support drum area that an be used to chamfer the edges.

14. A machine according to claim 1 further comprising a control device comprising a set of pedals linked to the frame that actuate a set of switches corresponding to several basic cycles wherein said control device includes means for performing:

an initial machining cycle for an alpine ski with a high belt speed, a low ski feed speed and a low or medium pressure force, a finishing cycle for an alpine ski with a low belt speed, a high ski feed speed and a low pressure force, a flattening cycle for a ski with a high belt speed, a low ski feed speed and a high or medium pressure force, an initial machining cycle for a snow board with a high belt speed, a low ski feed speed and a high pressure force, a finishing cycle for a snow board with a low belt speed, a low ski feed speed and a high pressure force.

* * * * *